US006084972A

United States Patent [19]

van Halteren et al.

[11] Patent Number: 6,084,972

[45] Date of Patent: Jul. 4, 2000

[54] INTEGRATED MICROPHONE/AMPLIFIER UNIT, AND AMPLIFIER MODULE THEREFOR

[75] Inventors: Aart Zeger van Halteren, Hobrede; Engbert Wilmink, Delft, both of Netherlands

[73] Assignee: Microtronic Nederland B.V., Netherlands

[21] Appl. No.: 08/832,136

[22] Filed: Apr. 3, 1997

[30] Foreign Application Priority Data

Apr. 3, 1996 [NL] Netherlands ..... 1002783

[51] Int. Cl.[7] ..... H04R 3/00

[52] U.S. Cl. ..... 381/92; 381/312; 381/111

[58] Field of Search ..... 381/313, 113, 381/324, 114, 111, 112, 92, 322, 312

[56] References Cited

U.S. PATENT DOCUMENTS

| | | | |
|---|---|---|---|
| 3,270,146 | 8/1966 | Eberhard | 381/324 |
| 4,280,018 | 7/1981 | Lazarus | 381/114 |
| 4,516,428 | 5/1985 | Konomi | 381/113 |
| 4,888,807 | 12/1989 | Reichel | 381/113 |
| 4,993,072 | 2/1991 | Murphy . | |
| 5,337,011 | 8/1994 | French et al. . | |

FOREIGN PATENT DOCUMENTS

| | | |
|---|---|---|
| 0 670 602 | 9/1995 | European Pat. Off. . |
| 34 25 175 | 3/1986 | Germany . |
| WO 94/14239 | 6/1994 | WIPO . |

*Primary Examiner*—Minsun Oh Harvey
*Attorney, Agent, or Firm*—Michaelson & Wallace; Peter L. Michaelson

[57] ABSTRACT

The invention relates to an integrated microphone/amplifier unit, in particular for a hearing aid, which is largely insensitive to interference signals such as, for instance, could be caused by GSM telephone apparatuses because capacitive couplings are arranged between the amplifier output and ground, and between the feed and ground. These capacitive couplings are made by the thick-film technique and can be provided with a separate ground connection. In one embodiment the capacitive couplings comprise capacitors, of which the output and feed connections themselves form part. In another embodiment the capacitive couplings comprise capacitors that are formed on the back of a carrier.

22 Claims, 7 Drawing Sheets

INTEGRATED MICROPHONE/AMPLIFIER UNIT, AND AMPLIFIER MODULE THEREFOR

FIELD OF THE INVENTION

The invention relates to a microphone having an integrated amplifier. Such microphones are used, for instance, but not exclusively, in hearing aids.

BACKGROUND OF THE INVENTION

It has been found that such microphones may be sensitive to interference signals, more in particular high-frequency interference signals. An important source of high-frequency signals, that may interfere with such microphones is a GSM telephone apparatus. It has been found that such apparatus may generate signals having a frequency in the vicinity of 900 MHz and 1.8 GHz, which may give rise to interference signals that are perceptible to the user. The degree of interference may be so serious that the user of a hearing aid cannot make good use of a GSM or DECT telephone apparatus.

It is therefore an important object of the present invention to provide a microphone having an integrated amplifier, in which interfering signals in general, and high-frequency interference signals in particular, as, for instance, caused by GSM telephone apparatuses, are sufficiently suppressed.

To achieve this object, an integrated microphone/amplifier unit according to the invention has capacitively coupled power feed and output connections. Thus, interference signals that may be generated by the microphone are effectively short-circuited and are prevented from being present at the output of the integrated unit. Preferably, this short-circuit is realized to ground. It has been found that a value of about 30 pF already provides a good suppression of more than 20 db for frequencies as they occur during use of a GSM telephone.

A further aspect of the present invention relates to the construction of an amplifier module for such an integrated microphone/amplifier unit in miniature. In a macroscopic embodiment, two capacitive couplings can be rather easily provided by placing two capacitors. However, in miniature embodiments, such as, for instance, those necessary for use in a hearing aid, there is no room for individual capacitors.

SUMMARY OF THE INVENTION

It is therefore an object of the invention to provide an integrated microphone/amplifier unit in miniature, suitable for use in a hearing aid, in which the capacitive couplings are realized with a minimum of space. To this end, according to the present invention, the capacitive couplings are integrated into the amplifier module of the integrated microphone/amplifier unit by means of the thick-film technique.

In a preferred embodiment, the amplifier module according to the present invention is compatible and exchangeable with existing modules that are not provided with the capacitive couplings. This implies, inter alia, that the capacitive couplings must be incorporated into the amplifier module in a manner such that sizes of the modules remain the same, and that connecting points are in the same position. In one embodiment, the present invention attains this object by including the capacitive couplings in the connecting points. In another embodiment, the present invention attains this object by arranging the capacitive couplings at an opposite side of the module.

BRIEF DESCRIPTION OF THE DRAWINGS

These and other aspects, features and advantages or the present invention will be explained by the following description of preferred embodiments of an integrated microphone/amplifier unit according to the invention, with reference to the drawings, in which:

FIGS. 6A–C diagrammatically illustrate the layout of another embodiment of the invention, in which FIG. 6A is a top view and FIGS. 6B–C are bottom views.

DETAILED DESCRIPTION

Figure 1A:
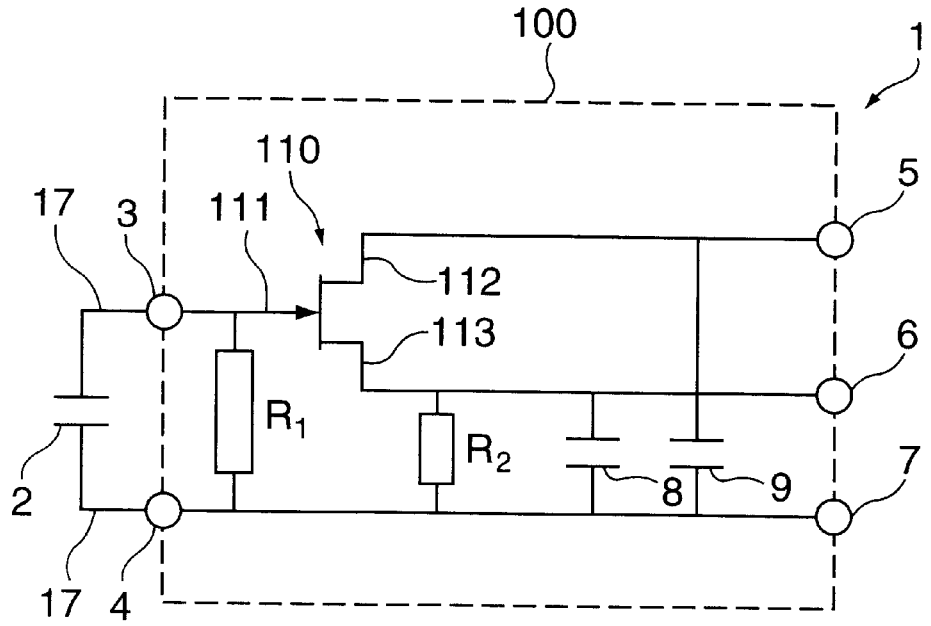
FIG. 1A is an electric schematic diagram of an integrated microphone/amplifier unit according to the invention.

The invention is particularly, but not exclusively, useful in a hearing aid and will therefore be described below in the context of such a practical example.

The structure and operation of an integrated microphone/amplifier unit 1 according to the invention will now be explained with reference to FIGS. 1A,2A and 2B. The microphone/amplifier unit 1, which is also briefly referred to as microphone, comprises a box-shaped housing 10 and a cover 11, a sound inlet nozzle 12, a backplate 13 provided with a charged electret layer, a membrane 14, a fastening plate 15, and an amplifier module 100. The combination of backplate 13 and membrane 14 is referred to as microphone capsule 2. In mounted condition (FIG. 2C), the backplate 13 with the membrane 14 is mounted near the bottom of the horsing 10, the fastening plate 15 is mounted on the housing 10, and the amplifier module 100 is mounted on the fastening plate 15. The cover 11 is placed over the module 100, with the electric connections 5, 6, 7 of the module 100 being left clear. Sound can reach the interior of the housing 10 via the sound inlet nozzle 12, thus causing the membrane 14 to move so that the electret-microphone capsule 2 generates an electric capsule signal. The electret-microphone capsule 2 is connected by means of connecting wires 17, which extend through a passage opening 16 in the fastening plate 15, with input connecting points 3 and 4 of the amplifier module 100 forming part of the unit 1, to supply the capsule signal thereto. The electric connecting points 5, 6, 7 comprise two connections 5, 7 for supplying electric power to the module 100, and a signal output connecting point 6 for supplying an amplifier output signal, also referred to as microphone signal. One of the feed connecting points 7 is connected with one of the input connecting points 4; this feed connecting point 7 will also be referred to as ground connection. The other feed connecting point 5 will also be referred to as feed input. The feed input 5 is usually positive with respect to the ground connection 7.

Since the nature and structure of the unit 1, in particular the structure of the membrane 14 and the microphone 2, further do not form an object of the present invention and the knowledge thereof is not necessary for a skilled worker to properly understand the present invention, these will not be described here in more detail. For a more extensive description of the operation of an electroacoustic transducer of the electret type and examples of possible constructions thereof, reference is made to the publication EP 0 533 284, the contents of which are held to be incorporated in the present application by reference.

The amplifier module 100 comprises an amplifier 110, which, in the case shown, is a source-follower connected FET. The amplifier 110 has an input 111, which is connected with the microphone input 3, and which is connected with the ground connection 7 via a first resistor R1. A feed input 112 of the amplifier 110 is connected with the feed input 5, while an output 113 of the amplifier 110 is connected with the ground connection 7 via a second resistor R2, and is further connected with the output connection 6.

According to an important aspect of the present invention, a first capacitive coupling 8 is present between the output connection 6 and the ground connection 7, and furthermore, a second capacitive coupling 9 is present between the feed input 5 and the ground connection 7. The capacity values of the two capacitive couplings 8 and 9 are about 30 pF in a suitable embodiment. To optimize the suppression at specific frequencies, however, another value may be selected for the above capacity, if desired.

If high frequency interference signals may be generated, e.g. as a result of the vicinity of a GSM telephone apparatus, these signals are short-circuited to ground by the capacitive coupling. Thus, the signal that can finally be derived at the output 6 is free of such interference signals. On the other hand, a value of the capacity is sufficiently low such that the impedance thereby defined has no effect on the audio signal produced by the microphone.

Figure 2A:
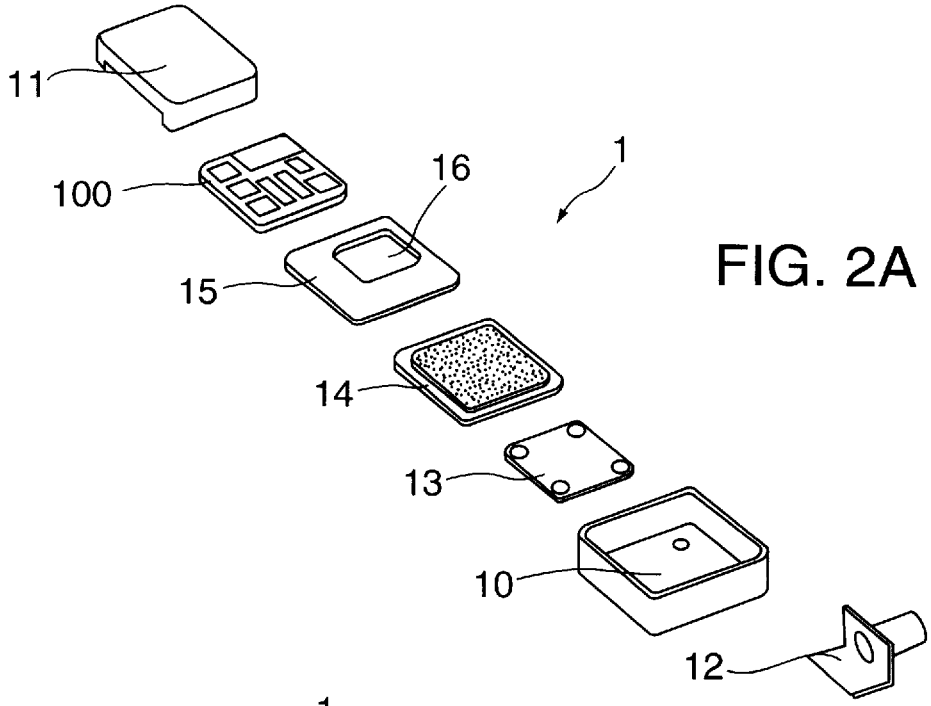
FIG. 2A is a diagrammatic perspective view of she main parts of an embodiment of an integrated microphone/amplifier unit according to the invention, in dismounted condition.
Figure 2B:
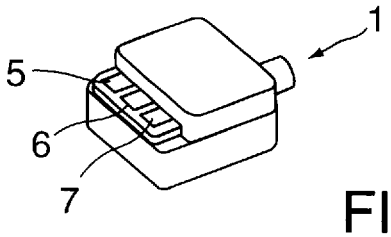
FIG. 2B is a diagrammatic perspective view of the integrated microphone/amplifier unit of FIG. 2A in mounted condition.
Figure 2C:
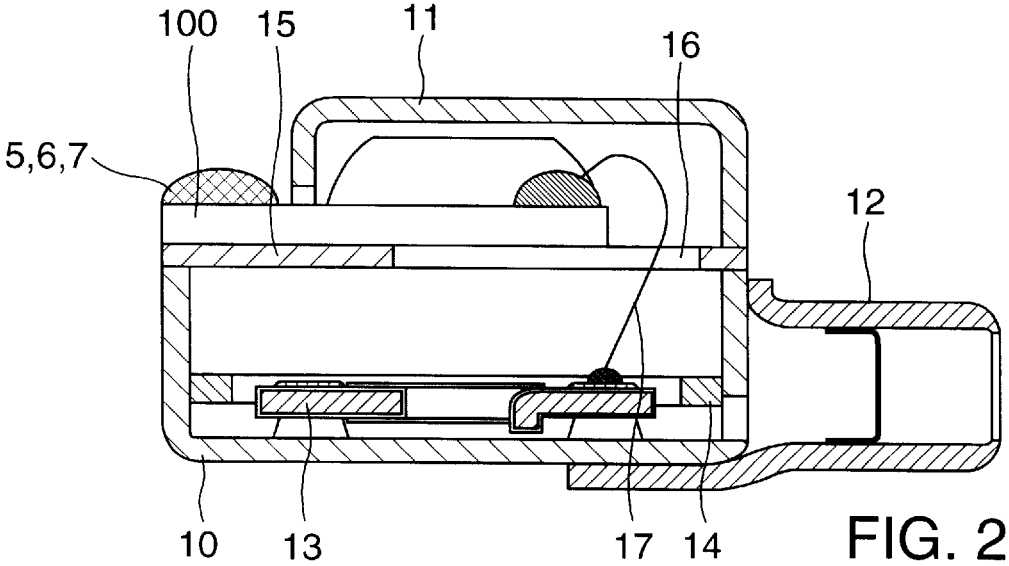
FIG. 2C is a diagrammatic view of the integrated microphone/amplifier unit of FIG. 2A in mounted condition.

As shown in FIG. 1A, the capacitive couplings 8, 9 preferably form part of the amplifier module 100 because it is then possible to have the amplifier module 100 itself provide an interference suppressed microphone signal at its output 6. Furthermore, it is then possible, as will be explained below in more detail, to design the amplifier module 100 in a manner such that, including the capacitive couplings 8, 9, it is exchangeable with existing modules that lack such a feature.

Figure 1B:
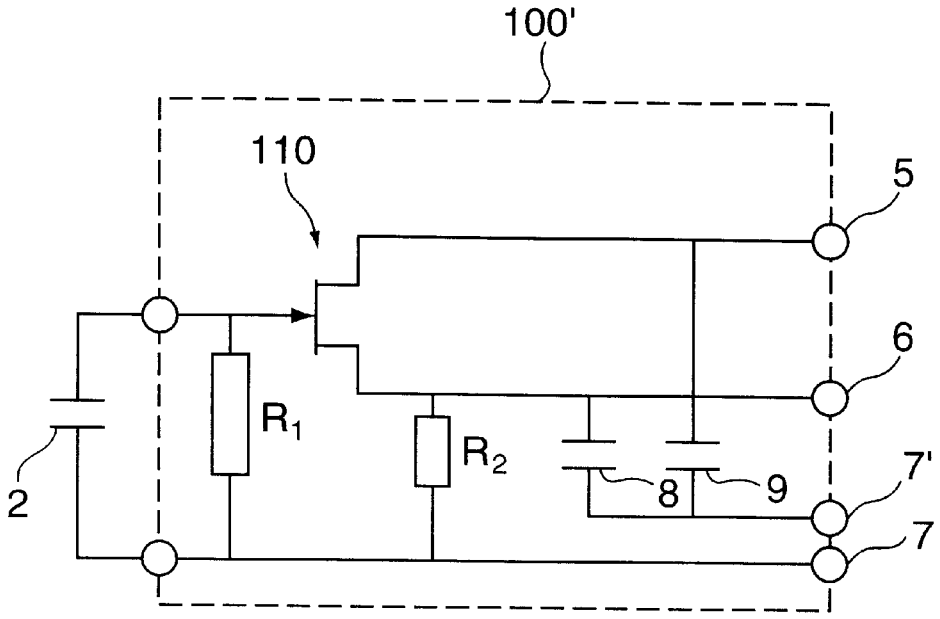
FIG. 1B is an electric schematic diagram of a variant of the integrated microphone/amplifier unit according to the invention.

FIG. 1B illustrates a variant 100' of the amplifier module 100 illustrated in FIG. 1A, in which an additional ground connection 7' is present besides the ground connection 7. The capacitive couplings 8, 9 are then realized with respect to this additional ground connection 7'; apart from that, the amplifier module 100' is identical to the amplifier module 100 of FIG. 1A. The advantage of an additional ground connection 7' is that the ground connection for the high-frequency interference signals is thereby separated from the ground connection for the low-frequency microphone signals so that the sensitivity of the unit 1 to high-frequency interference signals is further decreased. Preferably, the high-frequency ground connection 7' is connected with the conducting housing 10, 11 of the unit 1, but, for the sake of simplicity, this is not illustrated. The low-frequency ground connection 7 can then be coupled with the high-frequency ground connection 7' via an inductor (not shown).

Figure 3:
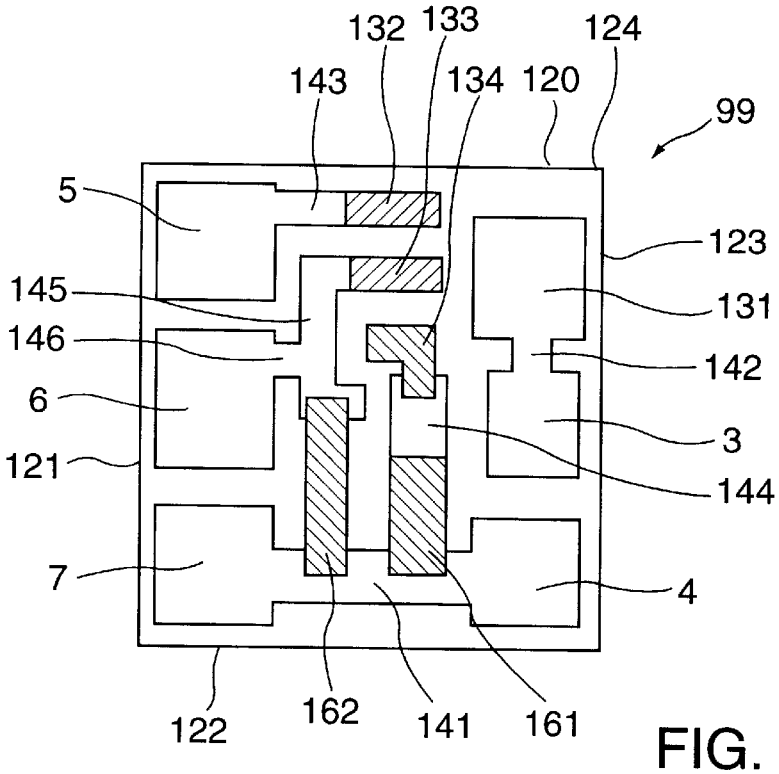
FIG. 3 is a diagrammatic top view of a known amplifier module to illustrate the layout thereof.

With reference to FIG. 3, the structure of an example of a known amplifier module will be described below, which will generally be indicated by reference numeral 99. The module 99 comprises a plate-shaped carrier 120 of an electrically insulating material, such as $A1_2O_3$, having a thickness of about 0.254 mm. The carrier 120 is substantially square and has four edges 121, 122, 123, 124, each having a length of about 2.8 mm. Applied to the carrier 120 is a pattern of a conducting material, such as copper or, preferably, an AgPd alloy having a thickness of about 10–14 $\mu$m. This pattern comprises a first island 131 for fastening the amplifier 110. Arranged on the carrier 120 near the first island 131 are contact surfaces 132, 133 and 134, with which the amplifier 110 can be connected by means of wire bonding. These contact surfaces 132, 133, 134 are made of gold having a thickness of about 10–12 $\mu$m.

The pattern of conducting material further comprises five islands defining the microphone connecting points 3, 4, the feed input 5, the ground connection 7 and the signal output connection 6. The feed input 5, the signal output connection 6 and the ground connection 7 are arranged, gram above to below in FIG. 3, along the first edge 121 of the carrier 120. The amplifier island 131 and the microphone connecting points 3, 4 are arranged, from above to below in FIG. 3, along the third edge 123, opposite the first edge 121.

The pattern further comprises some conducting connecting strips, as follows. Along the second edge 122 of the carrier 120 a first connecting strip 141 connects the microphone connecting point 4 with the ground connection 7. A second connecting strip 142 connects the other microphone connecting point 3 with the amplifier island 131. A third connecting strip 143 connects the first golden contact surface 132 with the feed input 5.

Arranged transversely to the first connecting strip 141 are two resistor surfaces 161 and 162 which define respectively the resistors R and R2. The first resistor surface 161 is connected by a fourth connecting strip 144 with the third golden contact surface 134. The second resistor surface 162 is connected by a fifth connecting strip 145 with the second golden contact surface 133. This fifth connecting strip 145 is connected by a sixth connecting strip 146 with the signal output connection 6.

As stated before, it is an object of the invention to provide a capacitive coupling between the connecting surfaces 5 and 7 and between connecting surfaces 6 and 7, with retention of the shape and size of the carrier 120, and with retention of the positions of the connecting surfaces 5, 6 and 7 on the carrier 120, while for acoustic reasons the air volume within the space enclosed by the housing 10 and the cover 11 are to be retained.

In a first approach, the present invention solves this problem by providing a conducting base surface below each of the connecting surfaces 5 and 6, with interposition of dielectric intermediate layers between these connecting surfaces 5 and 6, the conducting base surfaces being connected with a ground connection. The connecting surfaces 5 and 6 themselves then form, together with the conducting base surfaces a capacitor. Preferably, the conducting base surfaces, are integrally formed; the same applies to the dielectric intermediate layers. This approach will be explained with reference to FIGS. 4A–C, which illustrate the different layers of the module 100 according to the present invention, and FIG. 4D, which shows a cross-section taken along the line D—D in FIG. 4C. In FIGS. 4A–D, the same or comparable parts as in FIG. 3 are indicated by the same reference numerals.

Figure 4A:
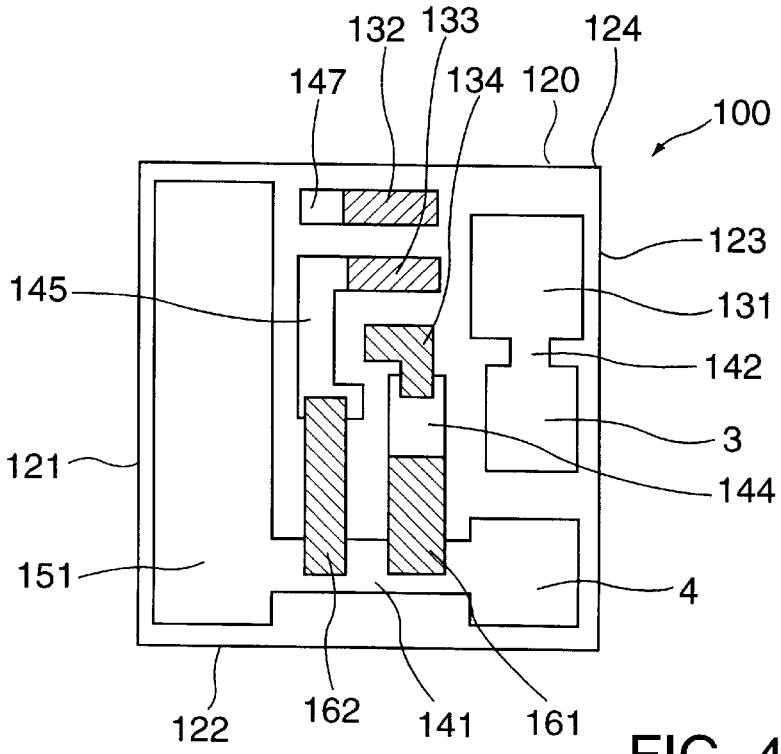
FIGS. 4A–C illustrate the layout of an amplifier module according to the present invention.

FIG. 4A shows the base pattern of an embodiment of the module 100 according to the present invention. A comparison with FIG. 3 will show that the connecting surfaces 5, 6 and 7 are replaced by a single conducting base surface 151, extending along the first edge 121 of the carrier 120, which base surface is connected with the first connecting strip 141. The sixth connecting strip 146 is absent, and the third connecting strip 143 is replaced by a short connecting strip 147, which is only connected with the first golden contact surface 132.

Figure 4B:
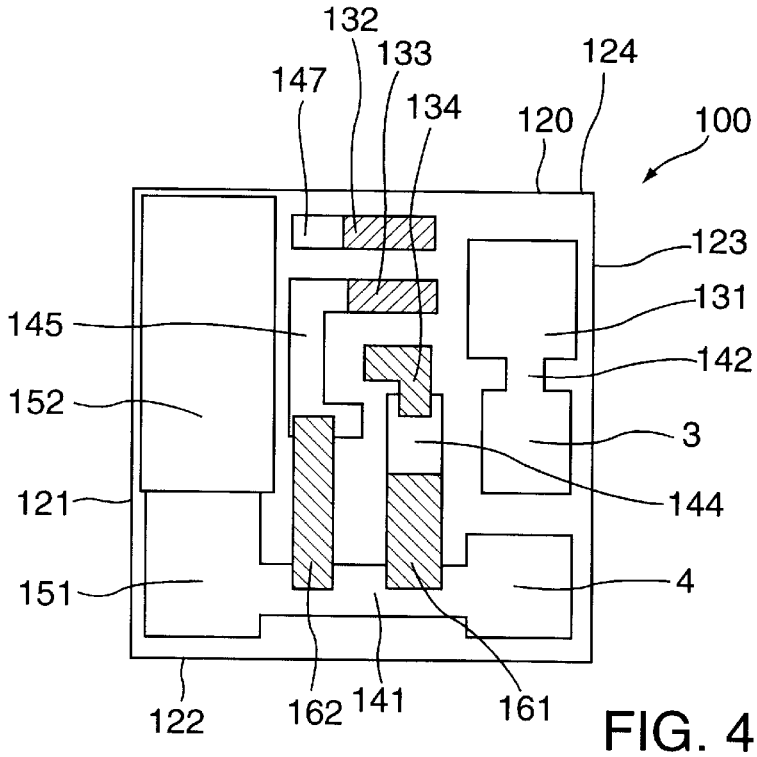
Figure 4C:
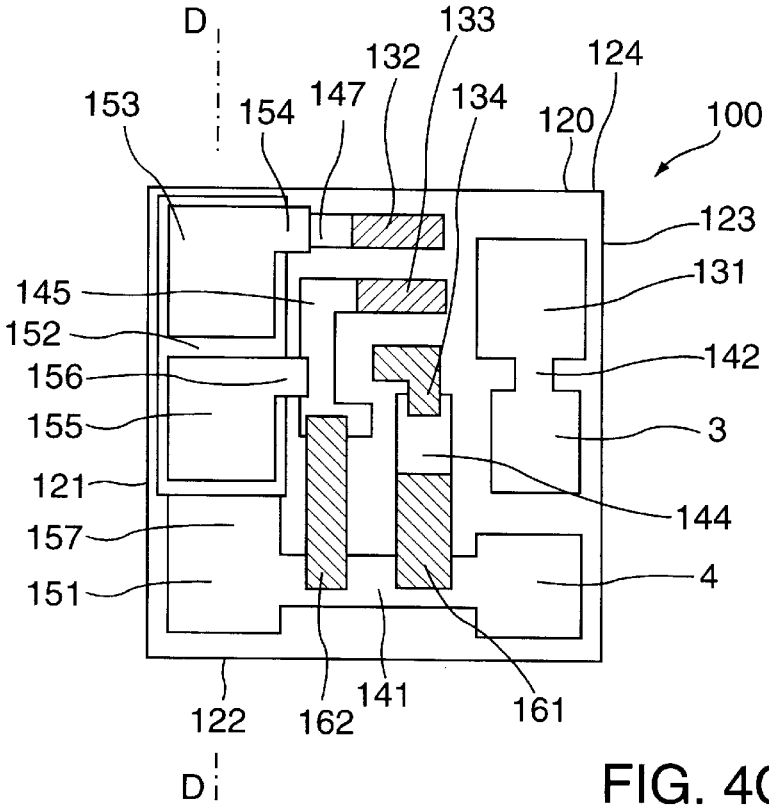
Figure 4D:
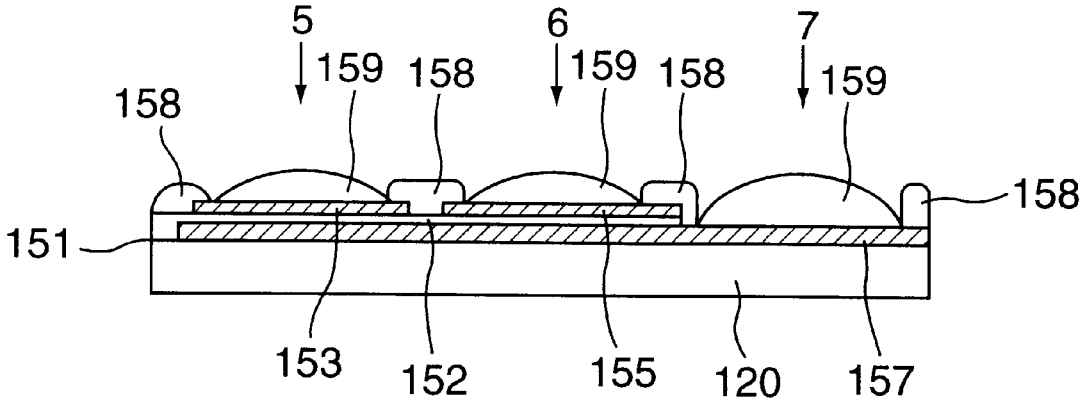
FIG. 4D is a diagrammatic cross-section taken along the line D—D in FIG. 4C.

FIG. 4B shows that an insulating dielectric layer 152 is applied over a part of the base surface 151. FIG. 4C show that, subsequently, a second pattern of conducting material, e.g. copper, but preferably AgPd, having a thickness of 10–14 $\mu$m, is applied over the dielectric layer 152. This second pattern comprises a first surface 153, which is connected via a connecting strip 154 with the short connecting strip 147, and a second surface 155, which is connected via a connecting strip 156 with the fifth connecting strip 145.

With regard to their position and function, the surfaces 153 and 155 correspond to the connecting points 5 and 6, while, as regards position and function, the part 157 of the conducting surface 151 not covered by the dielectric 152 corresponds to the ground connection 7.

Moreover, each of the surfaces 153 and 155 is capacitively coupled with the conducting surface 151, and thus with the surface part 157, and the capacity value may be about 30 pF by a suitable selection of type and thickness of the dielectric. In a suitable embodiment, each surface 153, 155 is about 0.7×0.7 mm, the dielectric has a thickness of about 40 $\mu$m and the dielectric preferably has an $\epsilon$-value greater than 200. A suitable dielectric material is commercially sold by DuPont, e.g. under the type designation 8229S. Applying the dielectric to the base surface 151 and applying a second pattern of conducting material over the dielectric layer 152 can be done by known per se processes, as will be clear to a skilled worker. Similarly, it will be clear to a skilled worker that, when applying the dielectric, care must be taken that the dielectric forms a continuous layer, that is to say without interruptions, because such interruptions are equivalent to a short circuit between the surfaces 153, 155 and 151.

Subsequently, an insulating frame 158, e.g. of glass, can be arranged over the carrier 120, with openings in the frame being aligned with the connecting surfaces 153, 155 and 157. The openings in the frame can be filled with solder 159, e.g. 62Sn/36Pb/2Ag. This is illustrated in the cross-section of FIG. 4D. It is clear therefrom that the appearance of the connecting points 5, 6 and 7 is unchanged when compared with the known module 99, but that the capacitive couplings 8 and 9 are provided notwithstanding, without requiring space.

As will be clear to a skilled worker, an amplifier 110 is arranged on the carrier 120, e.g. a JFET of the type J2N4338, the connecting points of which are connected with the connecting surfaces 132, 133, 134, e.g. by wire bonds, after which the whole of the FET and the wire bonds is encapsulated for protection purposes in, e.g., a resin. Since these steps do not form part of the present invention, while for these steps use can also be made of known per se processes already used in the manufacture of the known module 99, they are not discussed or illustrated in more detail.

It will be clear that thus, by applying the capacitive couplings immediately below the connecting surfaces, on the one hand a 100% exchangeability is obtained, while the acoustic volume is not impaired.

It will be clear to a skilled worker that it is possible to change or modify the shown embodiment of the apparatus according to the invention without departing from the inventive concept or the scope of protection. Thus, for instance, it is possible that the capacitive coupling between the output connection 6 and the ground connection 7 is replaced by a capacitive coupling between the output connection 6 and the feed connection 5 because this will also short-circuit high-frequency interference signals. In the case of an additional output connection 7' illustrated in FIG. 1B, this additional output 7' can be regarded, if desired, as a high-frequency feed connection. If desired, the feed connection 7 can also be capacitively coupled with the additional output connection 7'.

Furthermore, another amplifying circuit may be selected. In the illustrated example, the amplifier 110 is a buffer amplifier; it is also possible, however, that the amplifier effects amplification of the signal. Also, the amplifier 110 may be an IC.

In the illustrated embodiment, there is arranged on the conducting surface 151 one single dielectric layer 152, which extends below both surfaces 153 and 155. This is preferred, but, in principle, it is also possible to arrange a separate dielectric layer below each surface 153, 155.

Figure 5A:
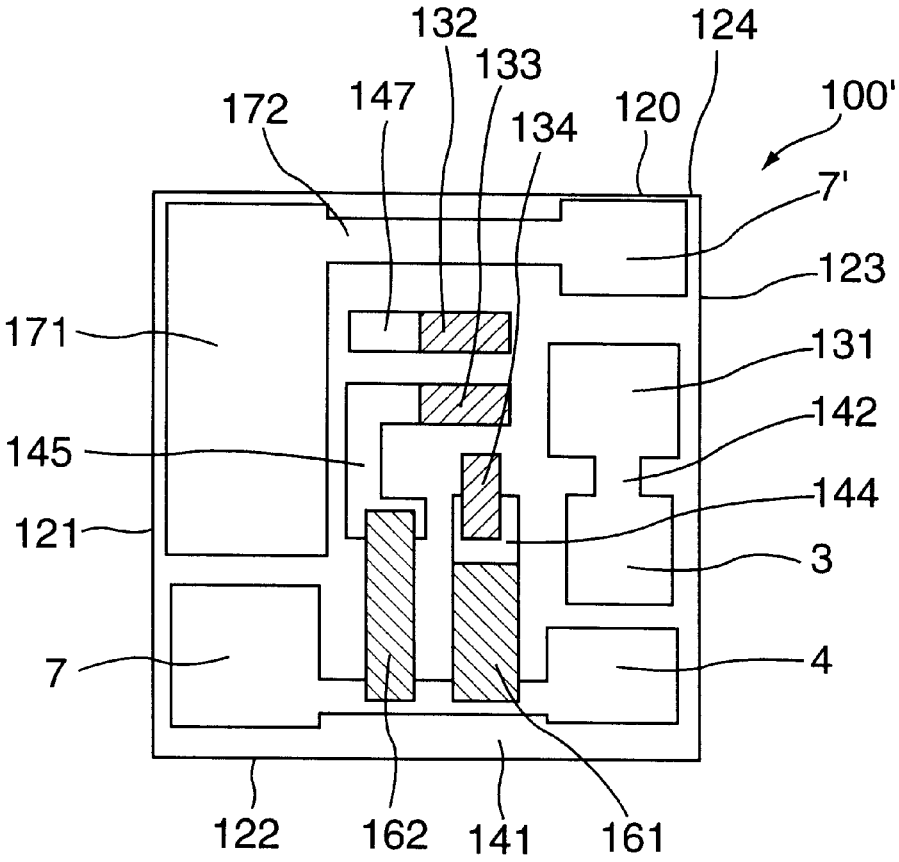
FIG. 5A is a view comparable to FIG. 4A of a layout of the variant shown in FIG. 1B.
Figure 5B:
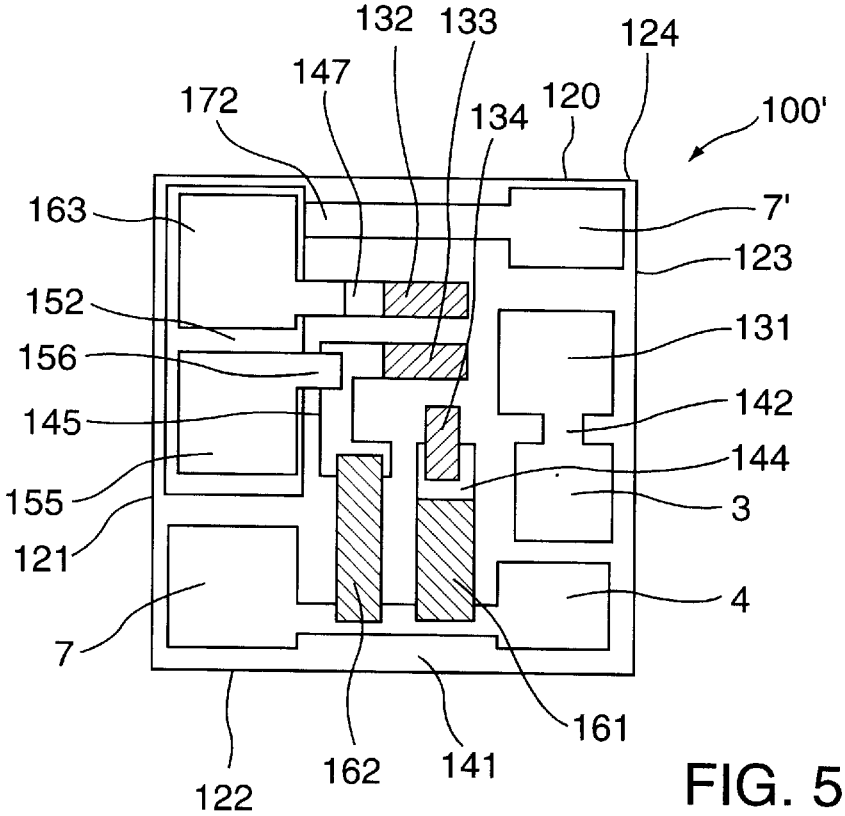
FIG. 5B is a view of the layout of the variant of the invention and comparable to FIG. 4C.

FIG. 5A shows the base pattern of a variant 100' of the amplifier .nodule, which is based on the schematic diagram of FIG. 1B. The same or comparable parts as in FIGS. 3 and 4A–D are indicated by the same reference numerals. A comparison with FIG. 3 will show that the connecting surfaces 5 and 6 are replaced by a single conducting surface 171, which, unlike FIG. 4B, has no electric connection with the connecting surface 7. At the third edge 123 of the carrier 120 the surfaces 4, 3 and 131 are slightly diminished and/or moved in the direction of the second edge 122 to make room for a HF ground connecting surface 7', which is connected with the surface 171 via a connecting strip 172 extending along the fourth edge 124.

In a comparable manner as illustrated in FIGS. 4B and 4C, there is arranged, as shown in FIG. 5A, over the surface 171 a dielectric layer 152, with the conducting surfaces 153, 155 over it, which are connected via conducting strips 154 and 156 with respectively the connecting strips 147 and 145.

In the foregoing, the invention has been described for an embodiment in which planar connecting points are formed on the module 100. In that case, a planar connecting point can be suitably used, as has been described, as a plate of a capacitor to be integrated on the module. It is also possible, however, to use the back of the carrier for the construction of capacitors, as will now be described, with reference to FIGS. 6A–6C, for a carrier 220 of a configuration different from the configuration of the carrier 120 described, but the electric diagram of which is equal to the diagram already described. Unlike the carrier 120, the carrier 220 is not provided with connecting surfaces formed on the carrier 220, but with connecting pins 203, 204, 205, 206, 207 fastened to the carrier 220, which, in the example to be described, run parallel to the plane of the carrier. Such an embodiment of the amplifier module is known, and here, too, there is a wish to provide this module with interference suppressing capacities with retention of the shape and sizes of the module, and with retention of the positions of the connecting pins.

Figure 6A:
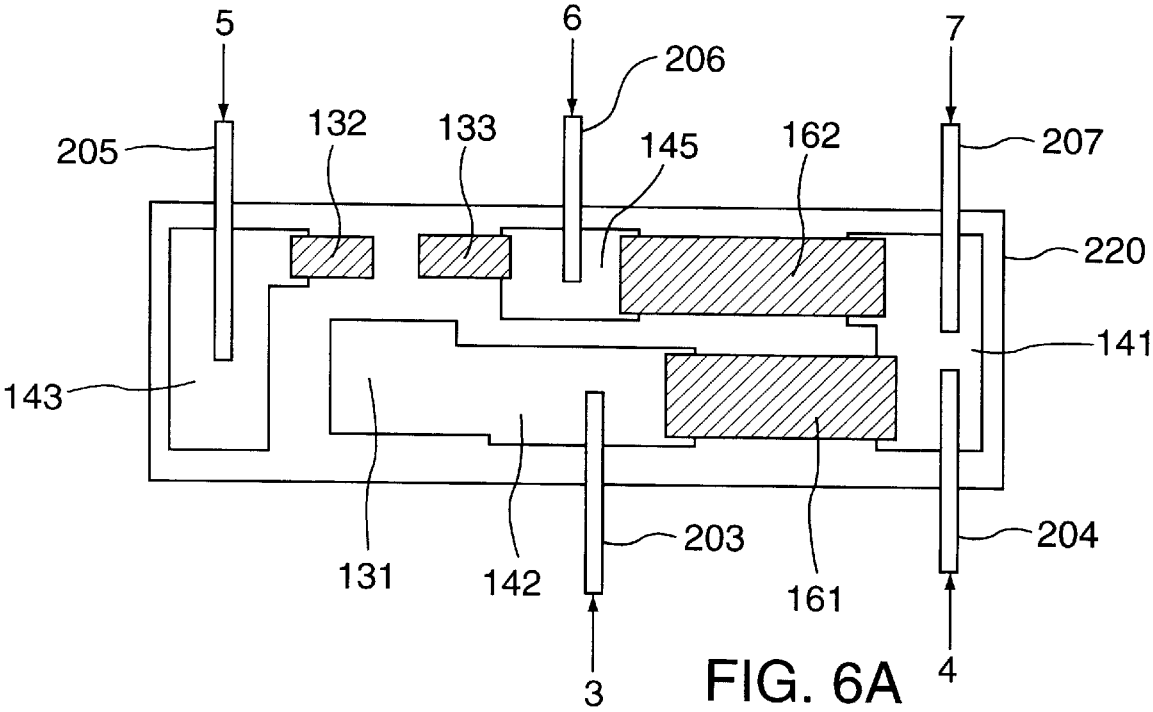

FIG. 6A shows an elongate carrier 220 having sizes of about 5 mm by about 1.6 mm. The same reference numerals as in FIG. 3 indicate the same or comparable parts. The first connecting strip 141 is located at a first end of the carrier 220 and extends over substantially the entire width of the carrier 220. Soldered to this first connecting strip 141 are two pins 204 and 207, which extend beyond the edges of the carrier 220, to define the connecting points 4 and 7. The two pins 204 and 207 may also be formed by a single continuous pin.

In a comparable manner, the third connecting strip 143 is located at the other end of the carrier 220 and extends over substantially the entire width of the carrier 220. Soldered to this third connecting strip 143 is a pin 205, which extends beyond the edge of the carrier 220 on the same side as the earlier mentioned pin 207, to define the connecting point 5. Between the pins 205 and 207 a pin 206 is soldered to the fifth connecting strip 145, to define the connecting point 6. On the opposite side a pin 203 is soldered to the second connecting strip 142, to define the connecting point 3. The pins may also be attached in a different manner, but soldering is preferred. It is observed that in this embodiment the third golden contact island 134 is omitted because the second connecting strip 142 also effects the connection between the surface 131 and the first resistor 161.

The parts discussed with reference to FIG. 6A are located on a first main surface of the carrier 220 and may be identical to the parts of an already known module as regards type and position. On the other main surface of the carrier 220 there are arranged according to the present invention means for providing a capacitive coupling 8 between the pins 205 and 207 and for providing a capacitive coupling 9 (as shown in FIGS. 1A and 1B) between the pins 206 and 207, as will be described with reference to FIGS. 6B and 6C.

Figure 6B:
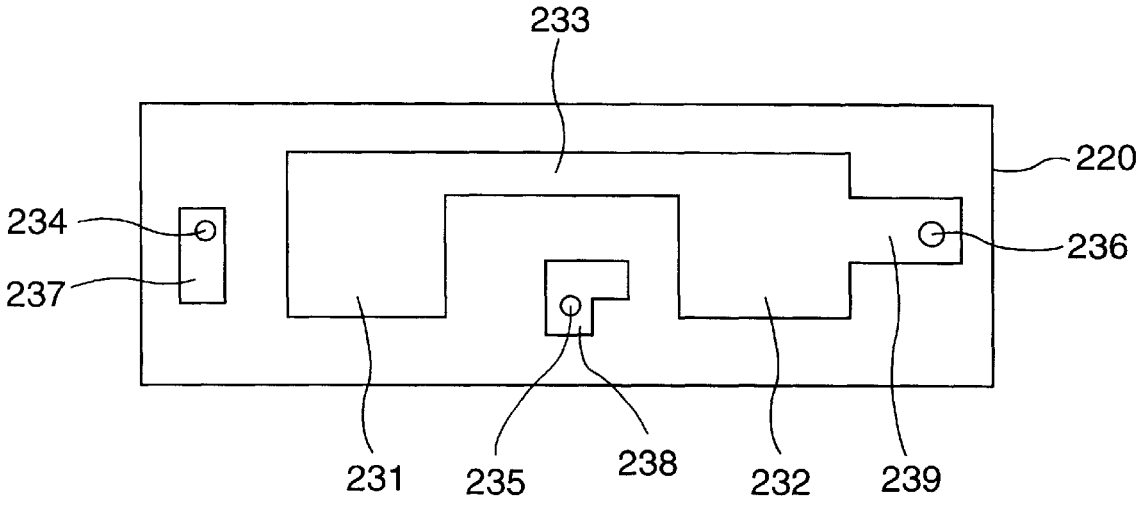

FIG. 6B shows that on an other main surface (opposite to that shown in FIG. 6A) of the carrier 220, too, there is arranged a pattern of a conducting layer. This pattern comprises two substantially square base surfaces 231 and 232, which are connected together by means of a connecting strip 233. Provided in the carrier 220 are three holes 234, 235 and 236, respectively at the height of the third connecting strip 143, the fifth connecting strip 145 and the first connecting strip 141. The pattern on the other main surface of the carrier 220 further comprises three contact surfaces 237, 238 and 239, which extend around respectively the holes 234, 235 and 236, and which are electrically connected through these holes with respectively the third connecting strip 143, the fifth connecting strip 145 and the first connecting strip 141, e.g. by bushings (not shown) introduced into the holes and secured on both sides by soldering. The third contact surface 238 is connected with the surface 232 so that both base surfaces 231 and 232 are electrically connected with the connecting point 7.

The two base surfaces 231 and 232 perform the same function as the base surface 151 discussed with reference to FIG. 4A.

Figure 6C:
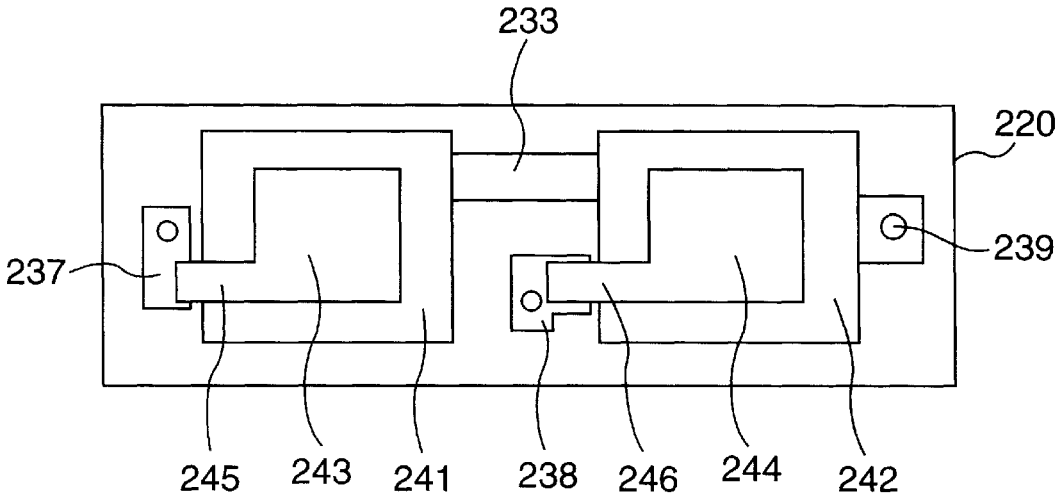

FIG. 6C shows that over the two base surfaces 231 and 232 there are arranged dielectric layers, respectively 241 and 242, which together perform the same function as the base surface 152 discussed with reference to FIG. 4B.

Over these dielectric surfaces 241 and 242 there are arranged conducting surfaces, respectively 243 and 244, which are connected by means of connecting strips, respectively 245 and 246, with the contact surfaces 237 and 238. Thus, the conducting surface 243 is electrically connected with the connecting point 5, and the conducting surface 244 is electrically connected with the connecting point 6.

It will be clear that the conducting surface 243 and the base surface 231 with the interposed dielectric layer 241 define a capacitor which defines the capacitive coupling 9, and that the conducting surface 244 and the base surface 232 with the interposed dielectric layer 242 define a capacitor which defines the capacitive coupling 8 (capacitive couplings 8 and 9 being schematically shown in FIGS. 1A and 1B).

Preferably, there is further arranged over the other main surface of the carrier 220 a protective layer, e.g. of glass.

It will be clear that variations and modifications of the examples of embodiment described are possible without departing from the scope of protection of the invention as set forth in the claims. Thus, for instance, the microphone 2 is shown as an electret, but this is not necessary.

What is claimed is:

1. An integrated microphone/amplifier unit comprising:

a microphone for generating a microphone signal in response to sound waves;

an amplifier, having an input coupled to the microphone and an output coupled with an output connection of the microphone/amplifier unit, for supplying an amplified microphone signal, the amplifier comprising a field-effect transistor (FET) configured as a source-follower, a source of the FET being coupled to the output of the amplifier so as to provide an unbalanced output; and first and second feed connections for connection with a supply source, the output connection of the amplifier being capacitively coupled, through a first capacitive coupling, with the first feed connection, and the first feed connection being capacitively coupled, through a second capacitive coupling, with the second feed connection, wherein capacitance values of both the first and second capacitive couplings are approximately equal to each other, wherein the first and second capacitive couplings suppress audible interference otherwise appearing in the amplified microphone signal appearing at the output and attributable to induced high frequency signals.

2. The integrated microphone/amplifier unit recited in claim 1 wherein the first feed connection is a ground connection.

3. The integrated microphone/amplifier unit recited to claim 1 wherein the capacitance values of the first and second capacitive couplings are approximately equal to 30 pF.

4. An amplifier module for an integrated microphone/amplifier unit, comprising:

a plate-shaped carrier having first and second opposing surfaces;

an amplifier arranged on the first or second surface of the carrier;

first, second and third connections for feed, output and ground connections, respectively; and first and second capacitive couplings situated on the carrier, the first capacitive coupling connected between the output connection and either the ground connection or the feed connection, and the second capacitive coupling connected between the feed connection and the ground connection;

a base conducting surface, electrically connected with the ground connection, situated on the first surface of the carrier;

a dielectric layer situated over the base conducting surface; and first and second conducting surfaces, situated on the dielectric layer opposite to the base conducting surface, such that the first and second conducting surfaces are capacitively coupled, through the capacitive couplings, with the base conducting surface and function as the feed and output connections; and wherein the first and second capacitive couplings are fabricated using a thick-film technique.

5. The amplifier module recited in claim 4 wherein the ground connection is formed by a corresponding portion of the base conducting surface that is not covered by the dielectric layer.

6. An amplifier module for an integrated microphone/amplifier unit, comprising:

a plate-shaped carrier having first and second opposing surfaces;

an amplifier arranged on the first or second surface of the carrier;

first, second and third connections for feed, output and ground connections, respectively; and first and second capacitive couplings situated on the carrier, the first capacitive coupling connected between the output connection and either the ground connection or the feed connection, and the second capacitive coupling connected between the feed connection and the ground connection;

a base conducting surface arranged on the first surface of the carrier and electrically connected with the ground connection via an opening in the carrier;

a dielectric layer situated over the base conducting surface; and first and second conducting surfaces, situated on the dielectric layer opposite to the base conducting surface, which are capacitively coupled, through the capacitive couplings, with the base conducting surface; and wherein the first and second conducting surfaces are electrically connected, via corresponding openings in the carrier, with the feed and the output connections, respectively, and the first and second capacitive couplings are fabricated using a thick-film technique.

7. An amplifier module for an integrated microphone/amplifier unit, comprising:

a plate-shaped carrier having first and second opposing surfaces;

an amplifier arranged on the first or second surface of the carrier;

first, second and third connections for feed, output and ground connections, respectively;

a fourth connection for an additional output connection; and first and second capacitive couplings situated on the carrier, the first capacitive coupling connected between the additional output connection and either the ground connection or the feed connection, and the second capacitive coupling connected between the feed connection and the additional output connection, wherein the first and second capacitive couplings suppress audible interference otherwise appearing in the output and additional output connections and attributable to induced high frequency signals; and wherein the first and second capacitive couplings are fabricated using a thick-film technique.

8. The amplifier module according to claim 7 further comprising:

a base conducting surface, arranged on the first surface of the carrier, electrically connected with the second output connection, a dielectric layer situated over the base conducting surface;

first and second conducting surfaces, situated on the dielectric layer opposite to the base conducting surface, which are capacitively coupled with the base conducting surface and function as the feed and the output connections, respectively.

9. An integrated microphone/amplifier unit comprising:

a microphone for generating a microphone signal in response to sound waves; and an amplifier, having an input coupled to the microphone and an output coupled with an output connection of the microphone/amplifier unit, for supplying an amplified microphone signal, the amplifier comprising a field-effect transistor (FET) configured as a source-follower, a source of the FET being coupled to the output of the amplifier so as to provide an unbalanced output; and first and second feed connections for connection with a supply source, the output connection of the amplifier being capacitively coupled, through a first capacitive coupling, with the first feed connection and the first feed connection being capacitively coupled, through a second capacitive coupling, with the second feed connection, wherein the first and second capacitive couplings suppress audible interference otherwise appearing in the amplified microphone signal appearing at the output and attributable to induced high frequency signals; and an amplifier module comprising:

a plate-shaped carrier having a first surface;

the amplifier arranged on the first surface of the carrier;

first, second and third connections for feed, output and ground connections, respectively; and first and second capacitive couplings situated on the carrier, the first capacitive coupling connected between the output connection and either the ground connection or the feed connection, and the second capacitive coupling connected between the feed connection and the ground connection; and wherein the first and second capacitive couplings are fabricated using a thick-film technique and have substantially equal capacitance values.

10. The integrated microphone/amplifier unit recited in claim 9 wherein the first feed connection is a ground connection.

11. The integrated microphone/amplifier unit recited in claim 9 wherein the amplifier module further comprises:

a base conducting surface, electrically connected with the ground connection, situated on the first surface of the carrier;

a dielectric layer situated over the base conducting surface;

first and second conducting surfaces, situated on the dielectric layer opposite to the base conducting surface, such that the first and second conducting surfaces are capacitively coupled with the base conducting surface and function as the feed and output connections, respectively.

12. The integrated microphone/amplifier unit recited in claim 9 wherein the amplifier module further comprises:

a base conducting surface arranged on a second surface of the carrier, the second surface being located opposite to the first surface, and electrically connected with the ground connection via an opening in the carrier;

a dielectric layer situated over the base conducting surface; and first and second conducting surfaces, situated on the dielectric layer opposite to the base conducting surface, which are capacitively coupled with the base conducting surface and electrically connected, via corresponding openings in the carrier, with the feed and the output connections, respectively.

13. A hearing aid having an integrated microphone/amplifier unit, the unit comprising:

a microphone for generating a microphone signal in response to sound waves;

an amplifier, having an input is coupled to the microphone and an output coupled with an output connection of the microphone/amplifier unit, for supplying an amplified microphone signal, the amplifier comprising a field-effect transistor (FET) configured as a source-follower, a source of the FET being coupled to the output of the amplifier so as to provide an unbalanced output; and first and second feed connections for connection with a supply source, the output connection of the amplifier being capacitively coupled, through a first capacitive coupling, with the first feed connection and the first feed connection being capacitively coupled, through a second capacitive coupling, with the second feed connection, wherein the first and second capacitive couplings suppress audible interference otherwise appearing in the amplified microphone signal appearing at the output and attributable to induced high frequency signals; and an amplifier module comprising:

a plate-shaped carrier having a first surface;

the amplifier arranged on the first surface of the carrier;

first, second and third connections for feed, output and ground connections, respectively; and first and second capacitive couplings situated on the carrier, the first capacitive coupling connected between the output connection and either the ground connection or the feed connection, and the second capacitive coupling connected between the feed connection and the ground connection; and wherein the first and second capacitive couplings are fabricated using a thick-film technique and have substantially equal capacitance values.

14. The hearing aid recited in claim 13 wherein the one feed connection is a ground connection.

15. The hearing aid recited in claim 13 wherein the amplifier module further comprises:

a base conducting surface, electrically connected with the ground connection, situated on the first surface of the carrier;

a dielectric layer situated over the base conducting surface;

first and second conducting surfaces, situated on the dielectric layer opposite to the base conducting surface, such that the first and second conducting surfaces are capacitively coupled with the base conducting surface and function as the feed and output connections, respectively.

16. The hearing aid recited in claim 13 wherein the amplifier module further comprises:

a base conducting surface arranged on a second surface of the carrier, the second surface being located opposite to the first surface, and electrically connected with the ground connection via an opening in the carrier;

a dielectric layer situated over the base conducting surface; and first and second conducting surfaces, situated on the dielectric layer opposite to the base conducting surface, which are capacitively coupled with the base conducting surface and electrically connected, via corresponding openings in the carrier, with the feed and the output connections, respectively.

17. An integrated microphone/amplifier unit comprising:

a microphone for generating a microphone signal in response to sound waves; and an amplifier, of which an input is coupled to the microphone, having an output coupled with an output connection of the microphone/amplifier unit for supplying an amplified microphone signal; and wherein the microphone/amplifier unit further comprises first and second feed connections for connection with a supply source and the output connection of the amplifier is capacitively coupled, through a first capacitive coupling, with the first feed connection, and the first feed connection is capacitively coupled, through a second capacitive coupling, with the second feed connection; and an amplifier module comprising:

a plate-shaped carrier having first and second surfaces;

the amplifier arranged on the first surface of the carrier;

first, second and third connections for feed, output and ground connections, respectively; and first and second capacitive couplings situated on the carrier, the first capacitive coupling connected between the output connection and either the ground connection or the feed connection, and the second capacitive coupling connected between the feed connection and the ground connection;

a base conducting surface, electrically connected with the ground connection, situated on the first or the second surface of the carrier;

a dielectric layer situated over the base conducting surface;

first and second conducting surfaces, situated on the dielectric layer opposite to the base conducting surface, such that the first and second conducting surfaces are capacitively coupled, through the first and second capacitive couplings, with the base conducting surface, wherein the first and second conducting surfaces function as the feed and output connections, respectively; and wherein the first and second capacitive couplings are fabricated using a thick-film technique.

18. The integrated microphone/amplifier unit recited in claim 17 wherein the first feed connection is a ground connection.

19. The integrated microphone/amplifier unit recited in claim 17 wherein the amplifier module further comprises:

a base conducting surface arranged on the second surface of the carrier, the second surface being located opposite to the first surface, and electrically connected with the ground connection via an opening in the carrier;

a dielectric layer situated over the base conducting surface; and first and second conducting surfaces, situated on the dielectric layer opposite to the base conducting surface, which are capacitively coupled with the base conducting surface and electrically connected, via corresponding openings in the carrier, with the feed and the output connections, respectively.

20. A hearing aid having an integrated microphone/amplifier unit, the unit comprising:

a microphone for generating a microphone signal in response to sound waves;

an amplifier, of which an input is coupled to the microphone, having an output coupled with an output connection of the microphone/amplifier unit for supplying an amplified microphone signal; and wherein the microphone/amplifier unit further comprises first and second feed connections for connection with a supply source and the output connection of the amplifier is capacitively coupled, through a first capacitive coupling, with the first feed connection, and the first feed connection is capacitively coupled, through a second capacitive coupling, with the second feed connection; and an amplifier module comprising:

a plate-shaped carrier having first and second surfaces;

the amplifier arranged on the first surface of the carrier;

first, second and third connections for feed, output and ground connections, respectively; and first and second capacitive couplings situated on the carrier, the first capacitive coupling connected between the output connection and either the ground connection or the feed connection, and the second capacitive coupling connected between the feed connection and the ground connection; and a base conducting surface, electrically connected with the ground connection, situated on the first or the second surface of the carrier;

a dielectric layer situated over the base conducting surface;

first and second conducting surfaces, situated on the dielectric layer opposite to the base conducting surface, such that the first and second conducting surfaces are capacitively coupled, through the first and second capacitive couplings, with the base conducting surface, the first and second conducting surfaces functioning as the feed and output connections, respectively; and wherein the first and second capacitive couplings are fabricated using a thick-film technique.

21. The hearing aid recited in claim 20 wherein the one feed connection is a ground connection.

22. A hearing aid having an integrated microphone/amplifier unit, the unit comprising:

a microphone for generating a microphone signal in response to sound waves;

an amplifier, of which an input is coupled to the microphone, having an output coupled with an output connection of the microphone/amplifier unit for supplying an amplified microphone signal; and wherein the microphone/amplifier unit further comprises first and second feed connections for connection with a supply source and the output connection of the amplifier is capacitively coupled, through a first capacitive coupling, with the first feed connection, and the first feed connection is capacitively coupled, through a second capacitive coupling, with the second feed connection; and an amplifier module comprising:

a plate-shaped carrier having first and second opposing surfaces;

the amplifier arranged on the first surface of the carrier;

first, second and third connections for feed, output and ground connections, respectively; and first and second capacitive couplings situated on the carrier, the first capacitive coupling connected between the output connection and either the ground connection or the feed connection, and the second capacitive coupling connected between the feed connection and the ground connection; and a base conducting surface arranged on the second surface of the carrier and electrically connected with the ground connection via an opening in the carrier;

a dielectric layer situated over the base conducting surface;

first and second conducting surfaces, situated on the dielectric layer opposite to the base conducting surface, which are capacitively coupled with the base conducting surface and electrically connected, via corresponding openings in the carrier, with the feed and the output connections, respectively; and wherein the first and second capacitive couplings are fabricated using a thick-film technique.

* * * * *